United States Patent [19]

Hughes

[11] Patent Number: 4,631,990

[45] Date of Patent: Dec. 30, 1986

[54] OPEN-ENDED RATCHET WRENCH

[76] Inventor: Matthew E. Hughes, 8511 Elmview Pl., Shreveport, La. 71108

[21] Appl. No.: 761,773

[22] Filed: Aug. 2, 1985

[51] Int. Cl.[4] ..... B25B 13/46

[52] U.S. Cl. ..... 81/62; 81/58.2

[58] Field of Search ..... 81/62–63.2, 81/58.2, 58.4, 111

[56] References Cited

U.S. PATENT DOCUMENTS

| | | | |
|---|---|---|---|
| 1,547,093 | 7/1925 | Burch | 81/63 |
| 2,758,493 | 8/1956 | Goldwater | 81/58.2 |
| 4,254,675 | 3/1981 | Marlow et al. | 81/63 |

*Primary Examiner*—Frederick R. Schmidt

*Assistant Examiner*—Debra S. Meislin

*Attorney, Agent, or Firm*—John M. Harrison

[57] ABSTRACT

An open-ended ratchet wrench characterized by arcuate fixed and pivoting jaw segments which receive round socket inserts of various design for achieving various drive functions. Typical inserts are box-end, socket drive and open-end inserts and the ratcheting function is adjusted for clockwise and counterclockwise operation by rotating the handle to manipulate a pair of pawls located in the fixed jaw segment. Removal and insertion of the inserts is achieved by manipulating a slide provided in cooperation with the handle to pivot the pivoting jaw segment with respect to the fixed jaw segment.

9 Claims, 8 Drawing Figures

FIG. 1
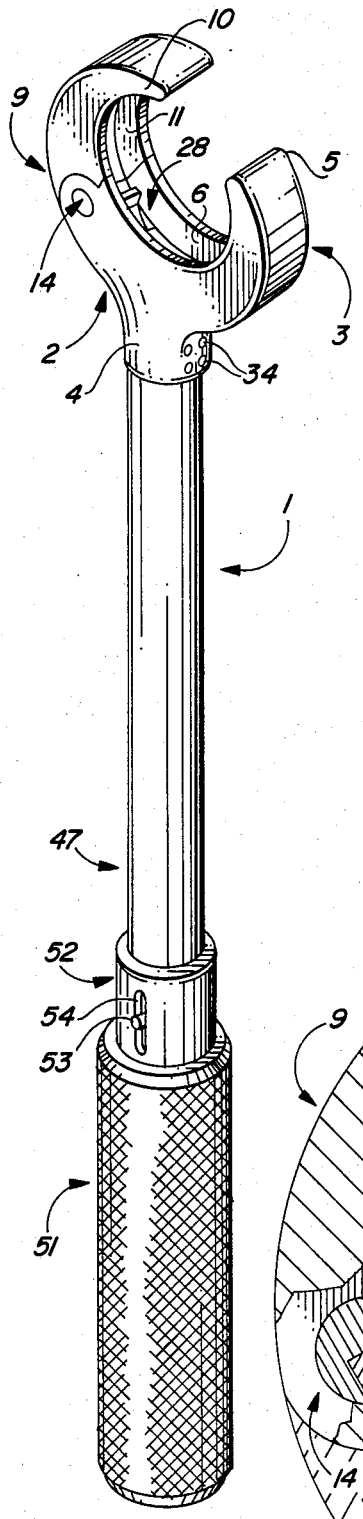
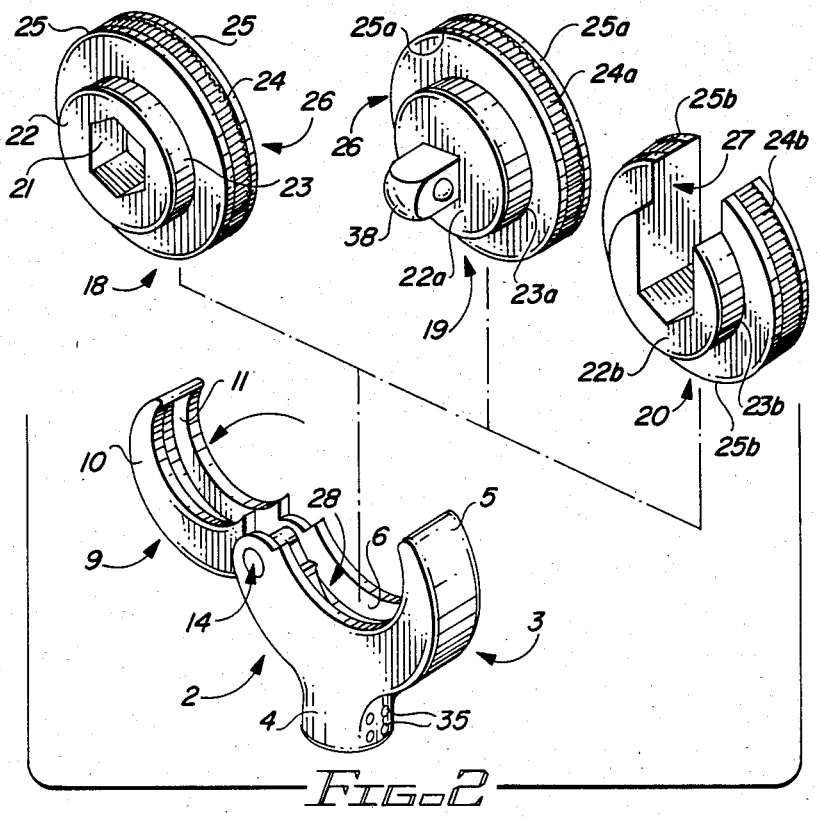
FIG. 2
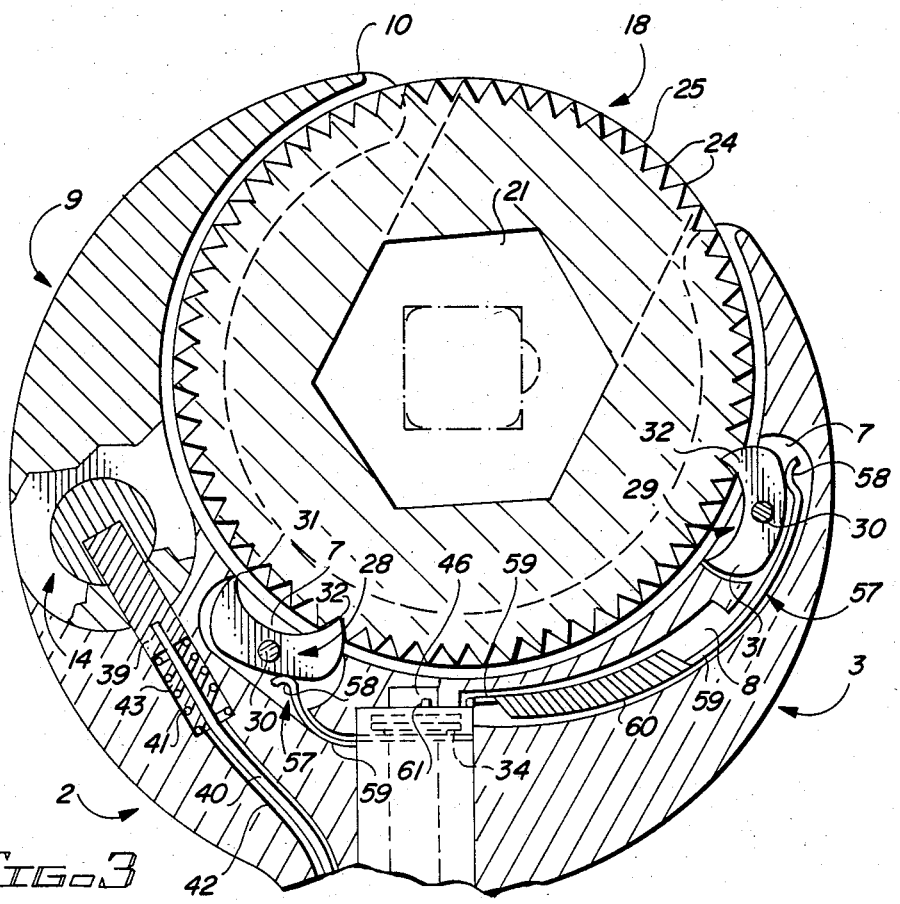
FIG. 3

OPEN-ENDED RATCHET WRENCH

BACKGROUND OF THE INVENTION

1. Field of the Invention

This invention relates to ratchet wrenches and more particularly, to an open-ended ratchet wrench which is characterized by arcuate fixed and pivoting jaw segments with a handle carried by the fixed jaw segment, and the pivoting jaw segment operated by a slide carried by the handle. The fixed and pivoting jaw segments are designed to receive round box-end, drive socket, and open-end inserts to facilitate various drive functions with the wrench. Manipulation of the ratchet wrench to facilitate clockwise and counterclockwise drive operations such as threading and unthreading of nuts and bolts and driving lag bolts is accomplished by a pair of pawls pivotally provided in the fixed jaw segment in association with teeth located in the periphery of each of the inserts. The pawls are operated by clockwise and counterclockwise rotation of the handle to adjust a pair of pawl contacts into alternative positions on the pawls. Opening and closing of the pivoting jaw is achieved by manipulation of a slide attached to the handle, which slide receives one end of a cable having the opposite end attached to a spring-loaded key, for alternative engagement and disengagement of the key in a slot provided in the pivoting jaw pin.

2. Description of the Prior Art

Ratchet wrenches having pawl mechanisms to facilitate clockwise and counterclockwise driving of sockets have long been known in the art. Some of these wrenches have been designed with open ends for access purposes and typical of these wrenches is the "Ratchet Wrench" disclosed in U.S. Pat. No. 2,527,033, dated Oct. 24, 1950, to R. H. Rodgers, et al. The Rodgers ratchet wrench is characterized by an open end, in order to accommodate unions, nuts, bolt heads and the like, of various size. An "Open Ended Ratchet Wrench" is disclosed in U.S. Pat. No. 2,712,259, dated July 5, 1955, to H. J. Cowell. The Cowell ratchet wrench is characterized by an open, arcuate engaging end which is provided with multiple, spring-loaded engaging members for engaging a nut, bolt head, or like member inserted in the jaws of the wrench. The projecting engaging members facilitate secure gripping of nuts, bolt heads and like members of various size. U.S. Pat. No. 2,757,564, dated Aug. 7, 1956, entitled "Broken Circle Ratchet Wrench", to A. C. Reaves, discloses an open-ended ratchet wrench which is designed to receive wrench heads of various size and shape for engaging couplings, unions and the like, of corresponding size and shape. The "Reversible Ratchet Wrench" disclosed in U.S. Pat. No. 2,758,493, dated Aug. 14, 1956, to M. H. Goldwater, includes a wrench having a pivotable rotary jaw or socket for placing directly on a nut disposed on piping, electrical conduits or on similar apparatus such that the nut is inaccessible from either end. U.S. Pat. No. 4,441,387, dated Apr. 10, 1984, to B. G. Hendricks, entitled "Open End Ratchet Wrench", includes an open-ended ratchet wrench which is characterized by a wrench disc having a radially disposed, open-ended nut recess. The nut recess carries pivoting tong ratchet pawls and the disc is held between two jaws, with ratchet teeth engaged by the pawls. One of the jaws is pivotally retractable for installation and removal of the interchangeable disc.

One of the problems which is inherent in prior art ratchet wrenches and particularly in ratchet wrenches of the open-ended design, is the lack of a versatile, positive facility for accommodating various types of drive and engaging mechanisms which can be usefully applied by the ratcheting function. Accordingly, it is an object of this invention to provide a new and improved, open-ended ratchet wrench which is characterized by a fixed jaw segment and a pivoting jaw segment designed to accommodate an open-end, box-end and socket drive insert, respectively.

Another object of this invention is to provide a new and improved, open-ended, pivoting jaw ratchet wrench which is capable of achieving box-end, open-end and socket drive ratchet functions by using round inserts fitted with teeth for receiving a pair of pawls in the ratchet wrench body.

Yet another object of this invention is to provide a new and improved ratchet wrench of the open-ended, pivoting jaw design, which wrench is provided with dual pawls operated by rotation of the handle and designed to engage the teeth of box-end, open-end and drive socket inserts fitted in the pivoting and fixed jaws of the wrench, respectively.

Yet another object of this invention is to provide a new and improved pivoting jaw ratchet wrench which is capable of receiving open-end, box-end and ratchet drive inserts, respectively, and is further capable of driving the inserts in a counterclockwise or clockwise ratcheting operation or locking the inserts with respect to the handle, as desired.

SUMMARY OF THE INVENTION

These and other objects of the invention are provided in a new and improved, open-ended, pivoting and fixed jaw ratchet wrench which is designed to receive a box-end open-end, and drive socket insert, respectively, by manipulation of a slide attached to the ratchet wrench handle to open and close the pivoting jaw. The ratcheting function is achieved by rotation of the wrench handle in the clockwise and counterclockwise direction to manipulate a pair of pawls mounted in the fixed jaw of the ratchet wrench and adjust the ratcheting function to a corresponding position or to lock the ratcheting function and selectively freeze the insert in the wrench head, as desired.

BRIEF DESCRIPTION OF THE DRAWING

The invention will be better understood by reference to the accompanying drawings, wherein:

FIG. 1 is a perspective view of the ratchet wrench of this invention, with the pivoting jaw in closed configuration;

FIG. 2 is a perspective of the box-end, open-end and socket drive inserts and the fixed and pivoting jaws, with the pivoting jaw in open configuration;

FIG. 3 is a sectional view of the fixed and pivoting jaws with a box-end insert in functional position therein;

DESCRIPTION OF THE PREFERRED EMBODIMENTS

Figure 4:
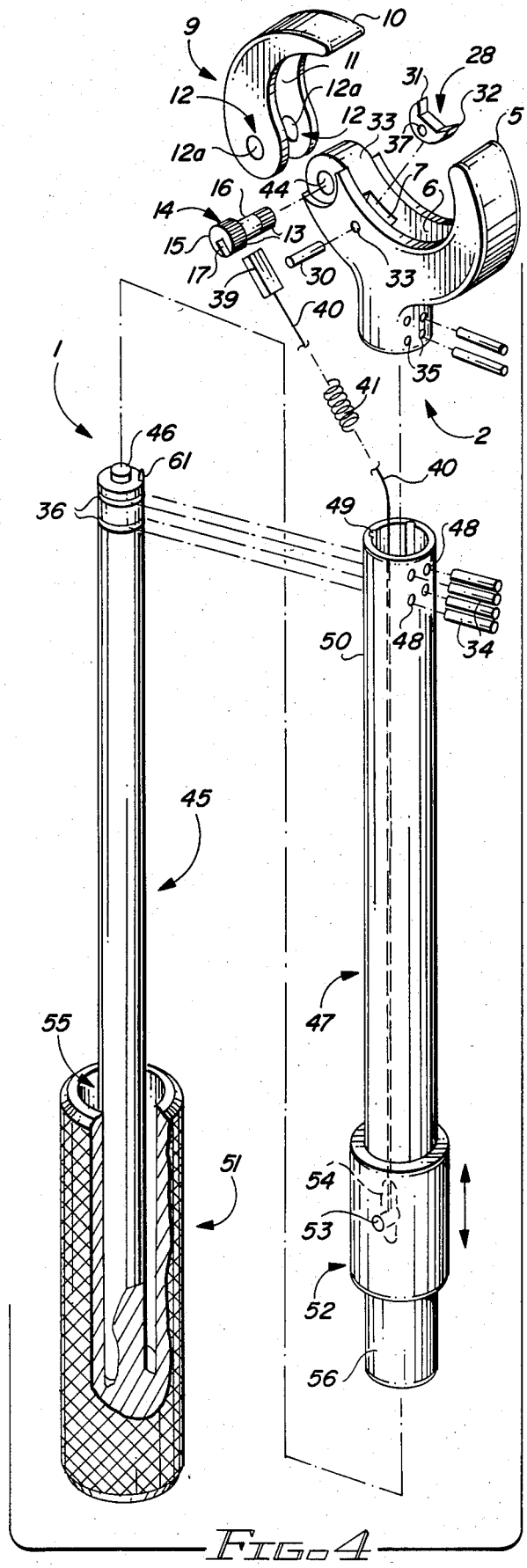
FIG. 4 is an exploded view of the ratchet wrench illustrated in FIGS. 1–3.

Referring initially to FIGS. 1 and 4 of the drawings, the ratchet wrench of this invention is generally illustrated by reference numeral 1. The ratchet wrench 1 includes an insert head 2, which is characterized by a fixed jaw 3, terminating in an upwardly curving fixed jaw tip 5, and a downwardly-depending collar 4. A fixed jaw slot 6 extends from the fixed jaw tip 5 throughout the concave curvature of the fixed jaw 3. A pivoting jaw 9 is attached at one end to the pivot post 33 of the insert head 2 by means of a pivot pin 14 and is curved to define a pivoting jaw tip 10 at the opposite end, which faces the fixed jaw tip 5. A pivoting jaw slot 11 is provided in the concave curvature of the pivoting jaw 9 and registers with the fixed jaw slot 6 at a point adjacent the pivot pin 14, as illustrated. The collar end 50 of a handle sleeve 47 is inserted in the collar 4 of the insert head 2 and is secured in this position by four roll pins 34. A slide 52 is concentrically located near the opposite, or base end 56, of the handle sleeve 47 and is designed to slide upwardly and downwardly on the handle sleeve 47 throughout the length of the slide pin slot 54, provided in the slide 52. A slide pin 53 is secured in transverse relationship to the handle sleeve 47 and extends through the slide pin slot 54, in order to limit the travel of the slide 52 on the handle sleeve 47. One end of the slide 52 recesses concentrically inside the slide space 55 of the handle 51, which is fixed to one end of a center shaft 45, extending the entire length of the handle sleeve 47, as hereinafter more particularly described.

Referring now to FIG. 2 of the drawings, the insert head 2 is designed to facilitate pivoting of the pivoting jaw 9 and pivot pin 14 with respect to the fixed jaw 3, to allow insertion of a round box-end insert 18, socket drive insert 19 or open-end insert 20 in the fixed jaw slot 6 and pivoting jaw slot 11, as illustrated. The box-end insert 18, socket drive insert 19 and open-end insert 20 are each provided with insert teeth 24, **24*a* and 24*b*, respectively, extending around the periphery and inwardly of the insert flanges 25, 25*a* and 25*b* respectively, provided in a round inset body 26. Furthermore, the box-end insert 18 is provided with a box-end opening 21 to fit a nut or bolt head or to receive certain drive members which are useful in performing various mechanical functions well known to those skilled in the art. In a preferred embodiment, a base 22,22*a* and 22*b*, respectively extends from the insert body 26 to define a base shoulder 23,23*a* and 23*b*, respectively in each of the box-end insert 18, socket drive insert 19 and open-end insert 22, as illustrated. Furthermore, a socket drive 38 projects from the base 22*a* of the socket drive insert 19 for engagement with conventional sockets and an insert slot 27 extends through the insert flanges 25*b* and the base 22*b* of the open-end insert 20** to accommodate a nut or a bolt head.

Figure 5:
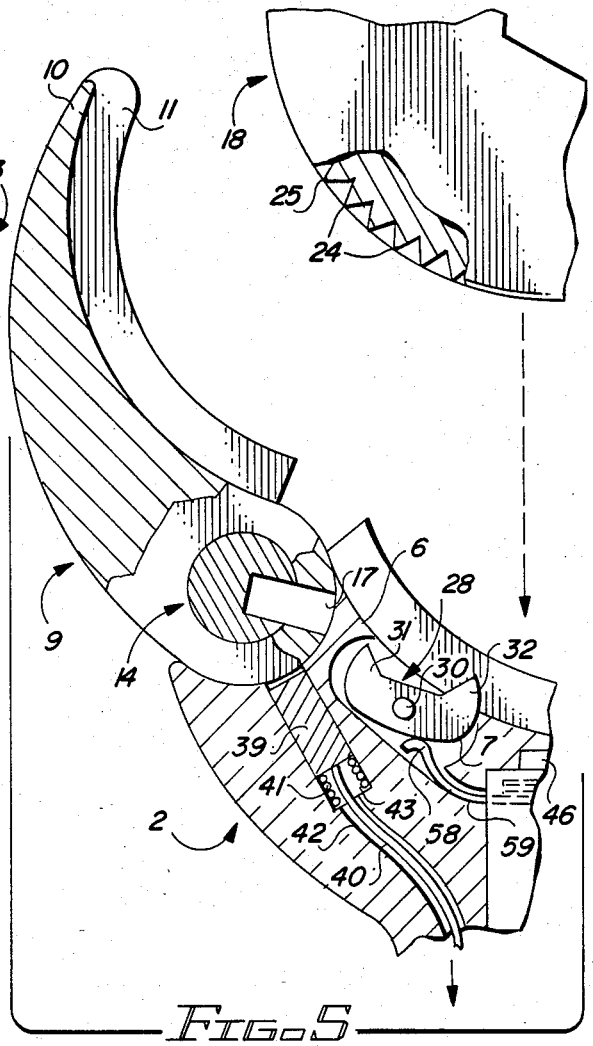
FIG. 5 is a sectional view of the pivoting jaw and a portion of the fixed jaw, more particularly illustrating the pivoting jaw lock and release mechanism.

Referring now to FIGS. 3–5 of the drawings, the interior of the ratchet wrench 1 is illustrated. The handle 51 is fixedly secured to one end of the center shaft 45 and the opposite end of the center shaft 45 is provided with roll pin grooves 36, for receiving the roll pins 34, which extend through the collar apertures 35 in the collar 4 and the sleeve apertures 48 in the handle sleeve 47. The center shaft 45 fits concentrically inside the handle sleeve 47. Accordingly, it will be appreciated that the handle sleeve 47, with the cooperating slide 52, can be removed from association with the collar 4, the center shaft 45 and the handle 51, by removing the roll pins 34. It will be further appreciated from a consideration of FIG. 4 that the base end 56 of the handle sleeve 47 which lies adjacent to the slide 52, projects into the slide space 55, which is concentrically defined by the inside surface of the handle 51 and the outside surface of the center shaft 45. A spring wrap 46 projects from the center of the extending end of the center shaft 45 for purposes which will be hereinafter described. As illustrated in FIG. 4, in a most preferred embodiment of the invention the pivot pin 14 is provided with an enlarged pivot pin head 15, which is provided with pin splines 13 and reduces in diameter to define a smooth pivot pin shank 16, terminating in additional pin splines 13. Cooperating jaw splines **12*a* are provided in the pivoting jaw apertures 12 located in the pivoting jaw 9, in order to register with the pin splines 13 in the pivot pin head 15 and the projecting end of the pivot pin shank 16. The pivot post 33, which extends from the insert head 2 opposite the fixed jaw 3, is provided with a pivot post aperture 44 which is smooth, in order to register with the smooth center portion of the pivot pin shank 16. Accordingly, since the pivot aperture 44 receives the smooth pivot pin shank 16 of the pivot pin 14 and since the pin splines 13 mate with the jaw splines 12*a* in the pivoting jaw 9, the pivoting jaw 9 and the pivot pin 14 rotate in concert in the pivot pin aperture 44 when it is desired to open and close the pivoting jaw 9. The opening and closing function is facilitated by the pivot key 39 and the cooperating pivot pin slot 17, located in the pivot pin 14. The pivot key 39 is slidably movable in a key chamber 43 and is attached to one end of a key cable 40, which extends from the key cable conduit 42 through the hollow interior of the handle sleeve 47. The opposite end of the key cable 40 is attached to the slide 52 by means of an aperture (not illustrated) in the wall of the handle sleeve 47 adjacent the slide 52. In a most preferred embodiment of the invention, the key cable 40 extends through a sleeve groove 49 provided in the interior wall of the handle sleeve 47. A key cable spring 41 is located in the key chamber 43, in order to bias the pivot key 39 in the pivot pin slot 17. Accordingly, referring to FIGS. 3–5 of the drawings, when it is desired to pivot the pivoting jaw 9 outwardly with respect to insert head 2, the slide 52 is first manipulated downwardly with respect to the handle sleeve 47, to retract the pivot key 39 against the bias of the key cable spring 41. This action removes the pivot key 39 from the pivot pin slot 17 in the pivot pin 14, as illustrated in FIG. 5, and allows the pivoting jaw 9 to swing outwardly and accommodate the box-end insert 18. Release of the slide 52 causes the slide 52 to move upwardly with respect to the handle sleeve 47 responsive to the tension in the key cable spring 41, which action forces the pivot key 39 upwardly and again into registration with the pivot pin slot 17 when the pivoting jaw 9 has been pivoted into its original, closed position, as illustrated in FIG. 3. This maneuver locks the pivoting jaw 9 inwardly to enclose and secure the box-end insert 18 in the fixed jaw slot 6 and pivoting jaw slot 11, of the fixed jaw 3 and the pivoting jaw 9**.

As further illustrated in FIGS. 3 and 4 of the drawings, when the box-end insert 18 is secured in the fixed jaw slot 6 and pivoting jaw slot 11 of the fixed jaw 3 and the pivoting jaw 9, the insert teeth 24 provided in the periphery of the box-end insert 18 are situated for engagement with the lower pawl teeth 32 and upper pawl teeth 31 of the bottom pawl 28 and the side pawl 29, respectively. The bottom pawl 28 and side pawl 29 are secured in pawl seats 7 provided in the fixed jaw 3 and the insert head 2, respectively, by means of pawl pins 30, inserted in pawl apertures 37. The bottom pawl 28 and side pawl 29 are free to pivot for alternative engagement of the upper pawl teeth 31 and the lower pawl teeth 32, repectively, with the insert teeth 24, responsive to pressure exerted by the contact ends 58 of the pawl contacts 57. One of the pawl contacts 57 extends into that pawl seat 7 which receives the bottom pawl 28 and the corresponding contact end 58 is biased into contact with the bottom pawl 28 by the tension in the stiff lead 59. The opposite end of the lead 59 in this pawl contact 57 is attacheted to a contact post 61, located on the end of the center shaft 45 near the perimeter thereof, in spaced relationship with respect to the center-mounted spring wrap 46. A second pawl contact 57 projects into the second pawl seat 7 which receives the side pawl 29 and the corresponding contact end 58 contacts the side pawl 29. In a preferred embodiment of the invention, a pawl spring 60 is provided in the lead 59 of this pawl contact 57 and is located in a spring seat 8 provided in the insert head 2, for purposes which will be hereinafter described. The opposite end of the lead 59 in this pawl contact 57 is also fixedly attached to the contact post 61.

Figure 6A:
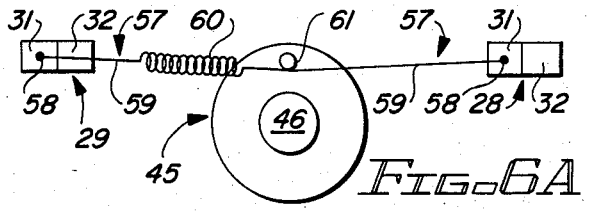
FIG. 6A is a schematic diagram illustrating a first position of the ratchet pawls.
Figure 6B:
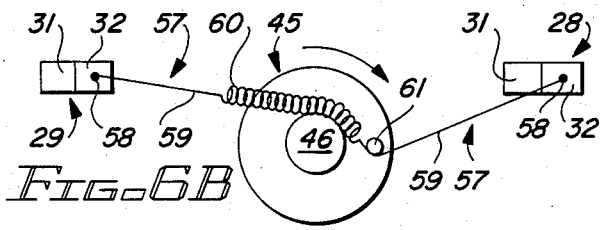
FIG. 6B is a schematic diagram illustrating a second position of the ratchet pawls.
Figure 6C:
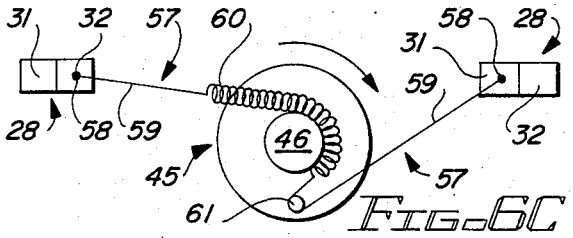
FIG. 6C is a schematic diagram illustrating a third position of the ratchet pawls.

Referring now to FIGS. 6A—6C of the drawings, the ratcheting function of the ratchet wrench 1 is switched from clockwise, to counterclockwise, to a locked configuration, in the following manner. As illustrated in FIG. 6A, when the center shaft 45 is positioned such that the center shaft 45 and contact post 61 are in the illustrated position, the contact ends 58 of the pawl contacts 57 engage the bottom pawl 28 and the side pawl 29 in the illustrated positions. Accordingly, the lower pawl tooth 31 of the side pawl 29 is in engagement with the insert teeth 24 of the box-end insert 18, while the upper pawl tooth 31 of the bottom pawl 28 is also in engagement with the insert teeth 24. However, when the center shaft 45 is rotated in the counterclockwise direction as indicated by the arrow in FIG. 6B, to a position where the contact post 61 is in a position approximately 90 degrees disposed from its original position, the pawl spring 60 is stretched somewhat around the spring wrap 46 and the contact ends 58 are displaced from their respective original positions. This displacement is effected by tension applied to the lead 59 in the pawl contact 57 which serves the bottom pawl 28 and compression in the lead 59 of the pawl contact 57 which operates the side pawl 29. The contact ends 58 now contact the lower pawl tooth 32 on both the bottom pawl 28 and the side pawl 29, to force each lower pawl tooth 32 into contact with the insert teeth 24. This position of the bottom pawl 28 and side pawl 29 is illustrated in FIG. 3 and allows the box-end insert 18 to ratchet in the direction of the arrow, also illustrated in FIG. 3. When the handle sleeve 47 is rotated an additional 90 degrees such that the contact post 61 is in the relative position illustrated in FIG. 6C, which position is 180 degrees disposed from the original contact post 61 position illustrated in FIG. 6A, the contact end 58 which operates the side pawl 29 is again displaced, while the contact end 58 which is in contact with the bottom pawl 28 is not. This action causes the upper pawl tooth 31 of the side pawl 29 to again engage the insert teeth 24, which, in cooperation with the engagement of the lower pawl tooth 32 of the bottom pawl 28 with the insert teeth 24, locks the box-end insert 18 and prevents ratcheting in either the clockwise or counterclockwise direction.

It will be appreciated by those skilled in the art that the ratchet wrench 1 of this invention provides a simple, yet highly expedient mechanism for a variety of mechanical applications requiring a ratcheting mechanism. For example, the open-end insert 20 can be quickly and easily inserted between the pivoting jaw 9 and fixed jaw 3 of the ratchet wrench 1 as heretofore described, to engage and tighten or loosen a bolt or nut in many applications where an open-end wrench will not function. Furthermore, the socket drive insert 19 can be similarly inserted and used to drive a deep or shallow socket and remove or tighten a nut or bolt in applications where a socket wrench is needed. The box-end can likewise be used in the insert head 2 of the ratchet wrench 1 to engage the head of a bolt or nut and tighten or loosen the bolt or nut, as deemed necessary. Furthermore, hexagonally shaped extensions can be inserted in the box-end opening of the box-end insert 18 for purposes and appplications which are well known to those skilled in the art. Other advantages of the ratchet wrench 1 of this invention will be apparent to those skilled in the art and while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An open-ended ratchet comprising a handle; a center shaft projecting from said handle in fixed relationship; a handle sleeve concentrically located on said center shaft in rotatable relationship; a curved fixed jaw carried by one end of said handle sleeve, said fixed jaw having a first concave slot therein; a curved pivoting jaw pivotally attached to said fixed jaw, said pivoting jaw having a second concave slot therein; lock means provided in association with said pivoting jaw and said fixed jaw for locking said pivoting jaw with respect to said fixed jaw; insert means removably insertable in said first concave slot and said second concave slot of said fixed jaw and said pivoting jaw responsive to pivoting of said pivoting jaw on said fixed jaw; and a first pawl and a second pawl pivotally carried by said fixed jaw in spaced relationship, said first pawl and said second pawl each having a pair of pawl teeth provided thereon and adapted for alternately pivoting into said first concave slot; a contact post extending from the end of said center shaft near the periphery of said center shaft; a spring wrap extending from the end of said center shaft substantially in the center of said end of said center shaft; a first pawl contact extending from sliding engagement with said first pawl at one end to fixed connection to said contact post at a second end and a second pawl contact extending from sliding engagement with said second pawl at one end to fixed connection to said contact post at a second end; and a pawl spring provided in said first pawl contact, whereby said first pawl contact and said second pawl contact are displaced on said first pawl and said second pawl, respectively, and said pawl spring is stretched around said spring wrap repsonsive to rotation of said handle and said center shaft, for selective engagement with said insert means and ratcheting of said insert means with respect to said fixed jaw and said pivoting jaw.

2. The ratchet wrench of claim 1 wherein said lock means further comprises a pivot pin fixedly carried by said pivoting jaw and rotatably cooperating with said fixed jaw for rotatably securing said pivoting jaw to said fixed jaw; a slot provided longitudinally in said pivot pin; a key slidably mounted in said fixed jaw in alignment with said slot; bias means seated in said fixed jaw against said key for normally biasing said key in said slot; and key slide means cooperating with said bias means for retracting said key from said slot against the bias of said bias means to facilitate pivoting of said pivoting jaw with respect to said fixed jaw.

3. The ratchet wrench of claim 2 wherein said insert means is selected from the group:

(a) a box-end insert characterized by a round body portion, insert teeth provided on the circumference of said body portion for engagement with said pawl means and a box-end opening in the center of said body portion;

(b) a socket drive insert characterized by a round body portion, insert teeth provided on the circumference of said body portion for engagement with said pawl means and a socket drive projecting from the center of said body portion; and (c) an open-end insert characterized by a round body portion, insert teeth provided on the circumference of said body portion for engagement with said pawl means and an insert slot provided in said body portion.

4. The ratchet wrench of claim 1 wherein said bias means is a coil spring and said key slide means is a slide concentrically located on said handle sleeve adjacent said handle and a key cable having one end secured to said slide and extending through said handle sleeve, with the opposite end of said key cable attached to said slide, whereby said key is withdrawn from said slot responsive to displacement of said slide on said handle sleeve toward said handle.

5. The ratchet wrench of claim 4 wherein said insert means is selected from the group:

(a) a box-end insert characterized by a round body portion, insert teeth provided on the circumference of said body portion for engagement with said pawl means and a box-end opening in the center of said body portion;

(b) a socket drive insert characterized by a round body portion, insert teeth provided on the circumference of said body portion for engagement with said pawl means and a socket drive projecting from the center of said body portion; and (c) an open-end insert characterized by a round body portion, insert teeth provided on the circumference of said body portion for engagement with said pawl means and an insert slot provided in said body portion.

6. An open-ended ratchet wrench comprising a handle; a center shaft projecting from said handle in fixed relationship; a handle sleeve concentrically located on said center shaft rotatable relationship; A curved fixed jaw removably carried by one end of said handle sleeve and a first concave slot provided in said fixed jaw; a curved pivoting jaw having one end pivotally attached to said fixed jaw and a second concave slot provided in said pivoting jaw, said first concave slot and said second concave slot is disposed substantially in alignment when said pivoting jaw is in a closed configuration; lock means slidably carried by said fixed jaw and adapted to cooperate with said pivoting jaw to maintain said pivoting jaw in non-pivoting relationship with respect to said fixed jaw; a first pawl and a second pawl pivotally carried by said fixed jaw in spaced relationship, said first pawl and said second pawl each having a pair of pawl teeth provided thereon and adapted for alternately pivoting into said first concave slot; a concave post extending from the end of said center shaft near the periphery of said center shaft; a spring wrap extending from the end of said center shaft substantially in the center of said end of said center shaft; a first pawl contact extending from sliding engagement with said first pawl at on end to fixed attachment to said contact post at a second end and a second pawl contact extending from sliding engagement with said second pawl at one end to fixed attachement to said contact post at a second end; and a pawl spring provided in said first pawl contact, whereby said first pawl contact and said second pawl contact are slidably displaced on said first pawl and said second pawl, respectively, and said pawl spring is stretched around said spring wrap responsive to rotation of said handle and said handle shaft; and insert means provided with teeth on the periphery thereof for insertion between said fixed jaw and said pivoting jaw, whereby said first pawl and said second pawl selectively engage said teeth responsive to manipulation of said handle.

7. The ratchet wrench of claim 6 wherein said lock means further comprises a pivot pin fixedly carried by said pivoting jaw and rotatably cooperating with said fixed jaw for rotatably securing said pivoting jaw to said fixed jaw; a slot provided longitudinally in said pivot pin; a key slidably mounted in said fixed jaw in alignment with said slot; bias means in association with said key for normally biasing said key in said slot; and key slide means cooperating with said key for retracting said key from said slot against the bias of said bias means to facilitate pivoting of said pivoting jaw with respect to said fixed jaw.

8. The ratchet wrench of claim 6 wherein said insert means is selected from the group:

(a) a box-end insert characterized by a round body portion, insert teeth provided on the circumference of said body portion for engagement with said pawl means and a box-end opening in the center of said body portion;

(b) a socket drive insert characterized by a round body portion, insert teeth provided on the circumference of said body portion for engagement with said pawl means and a socket drive projecting from the center of said body portion; and (c) an open-end insert characterized by a round body portion, insert teeth provided on the circumference of said body portion for engagement with said pawl means and an insert slot provided in said body portion.

9. The ratchet wrench of claim 8 wherein said bias means is a coil spring and said key slide means is a slide concentrically located on said handle sleeve adjacent said handle and a key cable having one end secured to said slide and extending through said handle sleeve, with the opposite end of said key cable attached to said slide, whereby said key is withdrawn from said slot responsive to displacement of said slide on said handle sleeve toward said handle.

* * * * *